US009561934B2

(12) United States Patent
Ericson et al.

(10) Patent No.: US 9,561,934 B2
(45) Date of Patent: Feb. 7, 2017

(54) ELEVATOR SYSTEM WITH GUIDE RAIL BRACKET

(75) Inventors: Richard J. Ericson, Southington, CT (US); Stephen R. Nichols, Unionville, CT (US); Daryl J. Marvin, Farmington, CT (US); Harold Terry, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 1144 days.

(21) Appl. No.: 13/201,652

(22) PCT Filed: Mar. 13, 2009

(86) PCT No.: PCT/US2009/037091

§ 371 (c)(1),
(2), (4) Date: Aug. 16, 2011

(87) PCT Pub. No.: WO2010/104515

PCT Pub. Date: Sep. 16, 2010

(65) Prior Publication Data

US 2011/0296772 A1 Dec. 8, 2011

(51) Int. Cl.
*B66B 7/02* (2006.01)
*B66B 13/30* (2006.01)

(52) U.S. Cl.
CPC ..... *B66B 7/024* (2013.01); *B66B 7/023* (2013.01); *B66B 13/30* (2013.01)

(58) Field of Classification Search
CPC ..... B66B 7/02; B66B 7/024; B66B 13/301; B66B 13/306
USPC ..... 187/406, 408, 325; 104/127; 52/30, 207, 52/745.2, 745.18
IPC ..... B66B 7/02,13/00, 13/30
See application file for complete search history.

(56) References Cited

U.S. PATENT DOCUMENTS

| | | | | |
|---|---|---|---|---|
| 585,222 | A | 6/1897 | McCool | |
| 156,541 | A | 11/1897 | Conrad et al. | |
| 1,083,508 | A | 1/1914 | Schlosser et al. | |
| 2,660,263 | A | 11/1953 | Raddatz et al. | |
| 3,601,938 | A * | 8/1971 | Loomis | 52/29 |
| 3,686,808 | A * | 8/1972 | Loomis | 52/211 |

(Continued)

FOREIGN PATENT DOCUMENTS

| | | | |
|---|---|---|---|
| DE | 20105144 | U1 | 7/2001 |
| EP | 0621224 | A2 | 10/1994 |

(Continued)

OTHER PUBLICATIONS

International Preliminary Report on Patentability for International application No. PCT/US2009/037091 mailed Sep. 22, 2011.

(Continued)

*Primary Examiner* — Minh Truong
(74) *Attorney, Agent, or Firm* — Carlson, Gaskey & Olds

(57) ABSTRACT

An exemplary door frame assembly that is useful in an elevator system includes a plurality of door frame members including a header, a sill and a plurality of jambs. The door frame members are configured to be secured into a desired position along a hoistway. At least one guide rail bracket is supported by at least one of the door frame members. The guide rail bracket is moveable relative to the door frame member between a handling position in which the guide rail bracket is generally parallel to at least one of the header or the sill and a deployed position in which the guide rail bracket is generally perpendicular to the at least one of the header or sill.

14 Claims, 5 Drawing Sheets

(56) References Cited

U.S. PATENT DOCUMENTS

| | | | | |
|---|---|---|---|---|
| 3,741,351 | A | 6/1973 | Suozzo | |
| 3,771,268 | A | 11/1973 | Loomis | |
| 3,881,575 | A | 5/1975 | Manaugh | |
| 3,948,358 | A * | 4/1976 | Atkey | 187/408 |
| 4,231,148 | A | 11/1980 | Harding | |
| 4,550,806 | A | 11/1985 | Bocker | |
| 4,793,441 | A | 12/1988 | Cilderman et al. | |
| 4,830,141 | A | 5/1989 | Montaigne | |
| 5,427,205 | A | 6/1995 | Saillio et al. | |
| 5,479,754 | A | 1/1996 | Pelvilain et al. | |
| 5,520,264 | A * | 5/1996 | Korhonen | 187/408 |
| 5,901,814 | A | 5/1999 | Adifon et al. | |
| 6,098,759 | A | 8/2000 | Rossman et al. | |
| 6,193,018 | B1 | 2/2001 | Schroder-Brumloop et al. | |
| 6,202,798 | B1 | 3/2001 | Friedman et al. | |
| 6,230,846 | B1 | 5/2001 | Namba et al. | |
| 6,446,762 | B1 | 9/2002 | St. Pierre et al. | |
| 6,481,538 | B2 | 11/2002 | Blackaby et al. | |
| 6,494,001 | B1 | 12/2002 | Ketonen et al. | |
| 6,651,780 | B1 | 11/2003 | Hakala et al. | |
| 6,672,013 | B1 * | 1/2004 | Glassey et al. | 52/30 |
| 6,848,543 | B2 | 2/2005 | Adifon et al. | |
| 6,938,380 | B2 | 9/2005 | Friedman et al. | |
| 7,147,086 | B2 | 12/2006 | Ach | |
| 7,267,200 | B2 | 9/2007 | Orrman | |
| 7,788,854 | B2 | 9/2010 | Friedman et al. | |
| 2006/0054419 | A1 * | 3/2006 | Friedman et al. | 187/211 |
| 2009/0065310 | A1 | 3/2009 | Flynn et al. | |
| 2012/0048654 | A1 | 3/2012 | Steward | |

FOREIGN PATENT DOCUMENTS

| | | | |
|---|---|---|---|
| EP | 1295839 | A1 | 3/2003 |
| JP | S58-87764 | U | 6/1983 |
| JP | 58151166 | | 10/1983 |
| JP | S59159676 | U | 10/1984 |
| JP | 199012875 | | 3/1990 |
| JP | 4354782 | | 12/1992 |
| JP | H0725565 | A | 1/1995 |
| JP | 11171430 | A | 6/1999 |
| JP | 0016733 | A | 1/2000 |
| JP | 200072354 | | 3/2000 |
| JP | 2003089490 | A | 3/2003 |
| WO | 2006082786 | A1 | 8/2006 |

OTHER PUBLICATIONS

Search Report for CN Application No. 200980158047.8 dated Mar. 13, 2009.

International Search Report and Written Opinion of the International Searching Authority for International Application No. PCT/US2009/037091 mailed Dec. 4, 2009.

Manual 208—Peelle Co., Frame Installation Manual Freight Doors—2002, 5 pages.

Noriago Elevator Brochure Mar. 1995; 12 pages.

Noriago Elevator Drawings; 7 pages.

Otis, Home Elevator, New Noriai-go Wide 20 Installation and Adjustment Manual; 119 pages.

International Search Report and Written Opinion of the International Searching Authority for International application No. PCT/US2009/037083 mailed Apr. 7, 2010.

International Preliminary Report on Patentability for International application No. PCT/US2009/037083 mailed Sep. 22, 2011.

Chinese Search Report for Application No. 200980158048.2 dated Jul. 24, 2013.

State Intellectual Property Office of People's Republic China, Supplementary Search for Application No. 200980158048.2 dated Aug. 29, 2014.

Extended European Search Report for Application No. EP 09 84 1626 dated May 9, 2016.

Extended European Search Report for Application No. EP 09 84 1627 dated May 9, 2016.

* cited by examiner

ELEVATOR SYSTEM WITH GUIDE RAIL BRACKET

BACKGROUND

Elevator systems are well known and in widespread use. There are various configurations of elevator systems. In many cases, an elevator car is associated with a counterweight and the two move in a coordinated fashion within a hoistway. The elevator car and counterweight each follow guide rails as they move within the hoistway.

Installing guide rails in an elevator system presents challenges and difficulties. A guide rail installation process is typically time-consuming and labor-intensive. There typically are many bracket components used for securing the guide rails in desired positions within a hoistway. Additionally, the alignment of the guide rails throughout the hoistway must be ensured to achieve proper ride quality.

For example, current rail fixings are adjustable for all of the rails. There are as many required alignment measurements as there are rails. This is normally done by dropping individual lines of wire from the top of the hoistway and then adjusting each of the rail blades square to the respective alignment wire.

If it were possible to streamline the guide rail installation process that would present cost savings in time and materials for elevator system manufacturers and installers.

SUMMARY

An exemplary door frame assembly that is useful in an elevator system includes a plurality of door frame members including a header, a sill and a plurality of jambs. The door frame members are configured to be secured into a desired position along a hoistway. At least one guide rail bracket is supported by at least one of the door frame members. The guide rail bracket is moveable relative to the door frame member between a handling position in which the guide rail bracket is generally parallel to at least one of the header or the sill and a deployed position in which the guide rail bracket is generally perpendicular to the at least one of the header or sill.

The various features and advantages of the disclosed example will become apparent to those skilled in the art from the following detailed description. The drawings that accompany the detailed description can be briefly described as follows.

DETAILED DESCRIPTION

Figure 1:
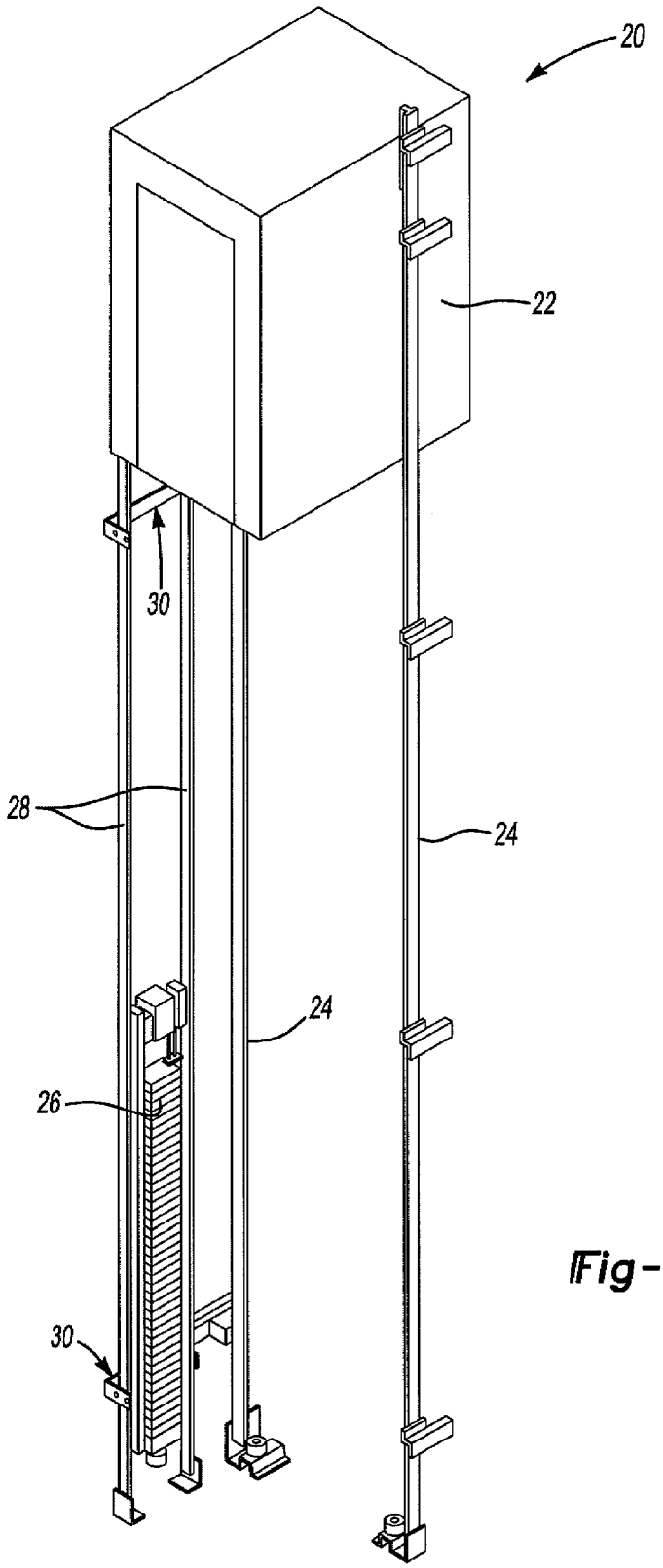
FIG. 1 diagrammatically illustrates selected portions of an elevator system including a guide rail bracket designed according to an embodiment of this invention.

FIG. 1 illustrates selected portions of an elevator system 20 including an elevator car 22 that is moveable along car guide rails 24. A counterweight 26 is associated with the elevator car 22 by a roping arrangement (not illustrated) and moves along counterweight guide rails 28 in coordination with movement of the elevator car 22. One of the car guide rails 24 and both of the counterweight guide rails 28 are on one lateral side (i.e., not the front side that includes the doors or the oppositely facing back side) of the elevator car 22. A plurality of brackets 30 secure those guide rails in their desired positions.

Figure 2:
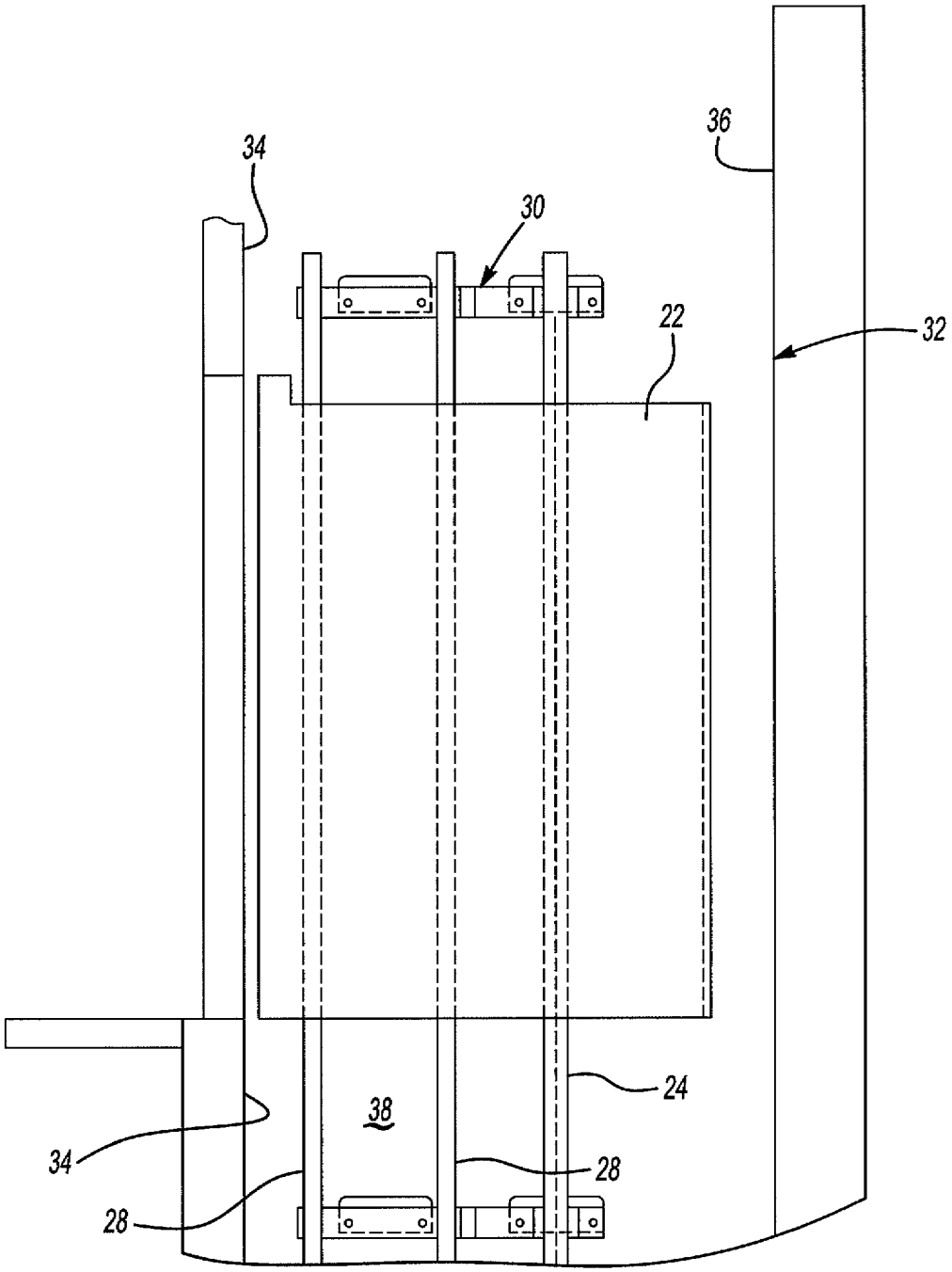
FIG. 2 is a side view of selected portions of the example of FIG. 1.

As can be appreciated from FIG. 2, the elevator car 22 and counterweight 26 are moveable within a hoistway 32 having a front wall 34 (i.e., the wall that includes the door), rear wall 36 and sidewalls 38. The brackets 30 are secured to the sidewall 38 on the lateral side of the elevator car selected for positioning the counterweight 26. As can be appreciated from FIG. 2, the counterweight guide rails 28 (and, therefore, the counterweight 26) are between the car guide rail 24 and the front wall 34 of the hoistway 32. In this example, the counterweight 26 has a reduced width compared to conventional counterweight arrangements so that the counterweight 26 and the counterweight guide rails 28 all fit within a front quadrant of the hoistway 32 (i.e., between a mid-point of the wall 38 and the front wall 34). In some examples, only a few brackets 30 are required along the entire length of the hoistway.

Figure 3:
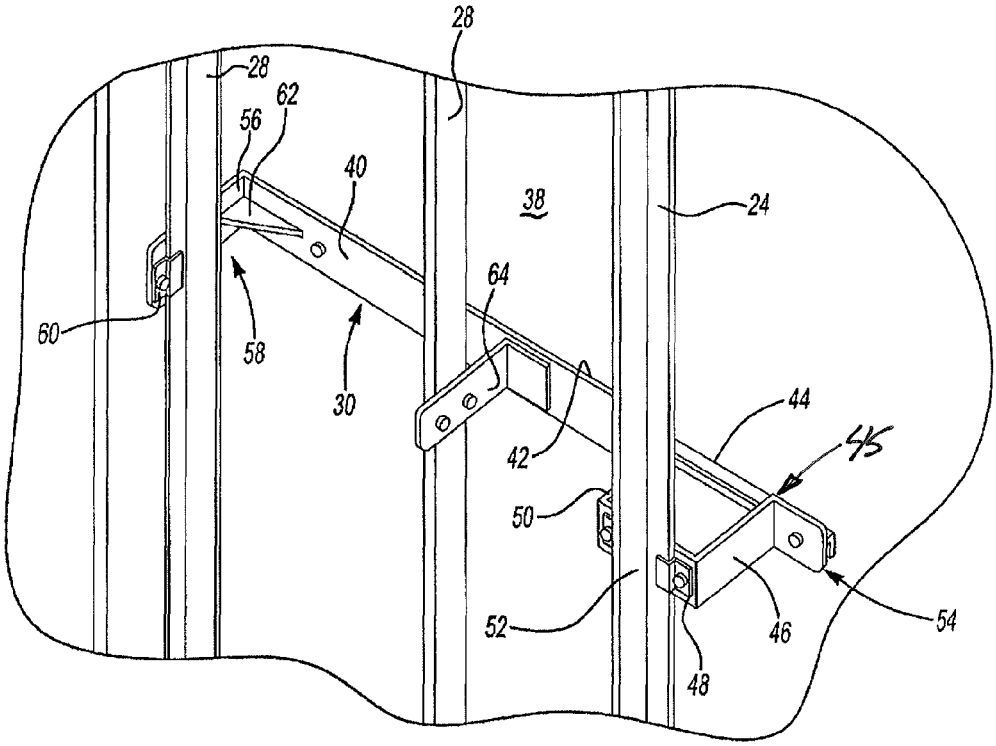
FIG. 3 is a perspective view of an example guide rail bracket and guide rails.
Figure 4:
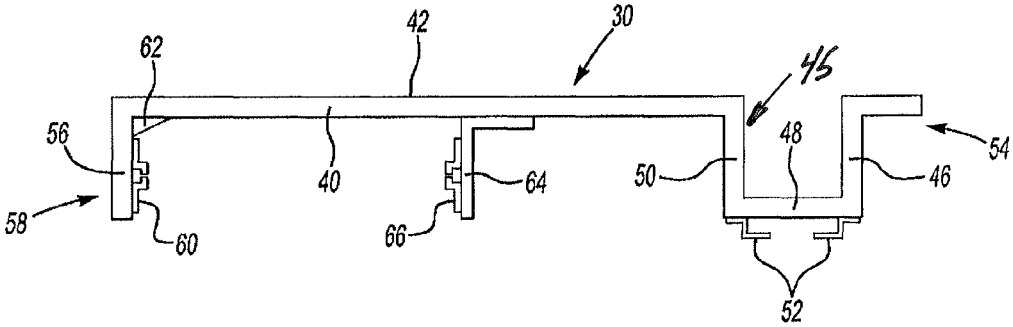
FIG. 4 is an elevational view of the example bracket of FIG. 3.

As best appreciated from FIGS. 3 and 4, the illustrated example bracket 30 includes a base 40 that is secured in a fixed position parallel to the hoistway wall 38. The base 40 is generally planar and has a surface 42 that is received toward and parallel with the hoistway wall 38. In this example, mounting members 44 facilitate making the connection between the bracket 30 and the hoistway wall 38. In another example, the surface 42 is received directly against the surface of the hoistway wall 38.

The example bracket 30 includes support arms for supporting the guide rails in desired vertical and horizontal positions at a selected distance away from the hoistway wall 38 and the other guide rails. A car guide rail support arm 45 comprises a plurality of bent sections in this example. A first section 46, a second section 48 and a third section 50 of the bracket 30 are bent relative to each other and the base 40. The first section 46 and the third section 50 are generally perpendicular to the second section 48 and the surface 42 of the base 40. The second section 48 includes a surface against which the car guide rail 24 is received and held in place using clips 52. In the illustrated example, threaded members such as bolts are used to hold the clips 52 in place for securing the corresponding portion of the car guide rail 24 against the car guide rail support arm 45.

The car guide rail support arm 45 is near one end 54 of the bracket 30. In one example the sections 46, 48 and 50 are established by bending a metal plate into the configuration shown in the illustrations. In this example, the car guide rail support arm 45 is a part of the same, single piece of material as the base 40.

Another section 56 of the bracket 30 is generally perpendicular to the surface 42 of the base 40. The section 56 establishes a counterweight guide rail support arm. One of the counterweight guide rails 28 is received against a surface on the section 56 and held in place by clips 60 and corresponding threaded fasteners.

In one example, the section 56 is established by bending the material of the bracket 30 near the second end 58. The illustrated example includes a reinforcing member 62 between the section 56 and the base 40 to maintain a desired alignment between them.

In one example, the base 40, the section 56 establishing the counterweight guide rail support arm and the sections 46, 48 and 50 establishing the car guide rail support arm are all formed from a single piece of material. In the illustrated example, that single piece of material comprises a metal plate.

Another counterweight guide rail support arm 64 is provided between the third section 50 and the section 56 of the bracket 30. In this example, the counterweight guide rail support arm 64 comprises a separate piece of material secured to the base 40. In one example, the counterweight guide rail support arm 64 has a portion that is welded to the base 40 of the bracket 30.

In the illustrated example, the car guide rail arm surface 48 is parallel to the base 40 and the hoistway wall 38. The rail receiving surfaces of the counterweight guide rail support arms 56 and 64 are perpendicular to the base 40 and the hoistway wall 38.

Utilizing a bracket such as the example bracket 30 facilitates various economies when installing guide rails within an elevator system. One feature is that there are less component pieces for an installer to handle during installation. The integrated bracket is lighter and easier to install compared to the conventional multiplicity of individual brackets. There are fewer alignment issues presented when using the example bracket 30. Further, the desired spacing between the guide rails remains consistent along the length of the hoistway, which reduces alignment adjustments. Having a preset distance between the guide rail support arms automatically establishes the spacing of the corresponding portions of the guide rails at the location of each bracket.

For example, instead of three individual alignment wires, a single alignment of the car guide rail (or one of the counterweight rails) provides placement of all three guide rails because the bracket 30 controls the position of all three based on the position of at least one of the three. Having the bracket 30 pre-dimensioned and accurately manufactured, therefore simplifies the installation process.

In some examples, the bracket 30 will have on end that is configured to be connected or placed against an attachment point on the door frame structures at the landings. This arrangement provides accurate front-to-back dimensioning if the door frame structures are appropriately aligned. In such an example, all three guide rails associated with the bracket 30 could be installed without requiring any hanging, alignment wires.

It is possible to have different strengths and material thicknesses for the support arms. For example, the counterweight rail support arms 56 and 64 may be less rigid than the car guide rail support arm 45. There is no concern of reaction of car safeties on the counterweight guide rails 28. The support arms 56 and 64, therefore, do not need to have the same ability to withstand any lateral forces otherwise introduced by a safety-induced stop of the elevator car 22.

Additionally, having three rails supported by the single bracket 30 structure provides reinforcement and load sharing properties. If each rail were supported independently using individual brackets, the car rail brackets experience the entirety of any such lateral force. With the integrated bracket design, the combined shear strength of the entire bracket resists the force associated with a safety stop.

Another feature of the integrated bracket design is that it provides a more stable base when a machine is mounted on a support that rests on one or more of the guide rails. With all three guide rails supported by the single bracket and the distribution of loads across the bracket, the stability of the base upon which the machine is supported is increased.

The bracket 30 also introduces additional options for elevator system configuration in a hoistway as the bracket facilitates utilizing a smaller sized counterweight that fits between the car guide rail 24 and the front wall 34 of the hoistway.

Figure 5:
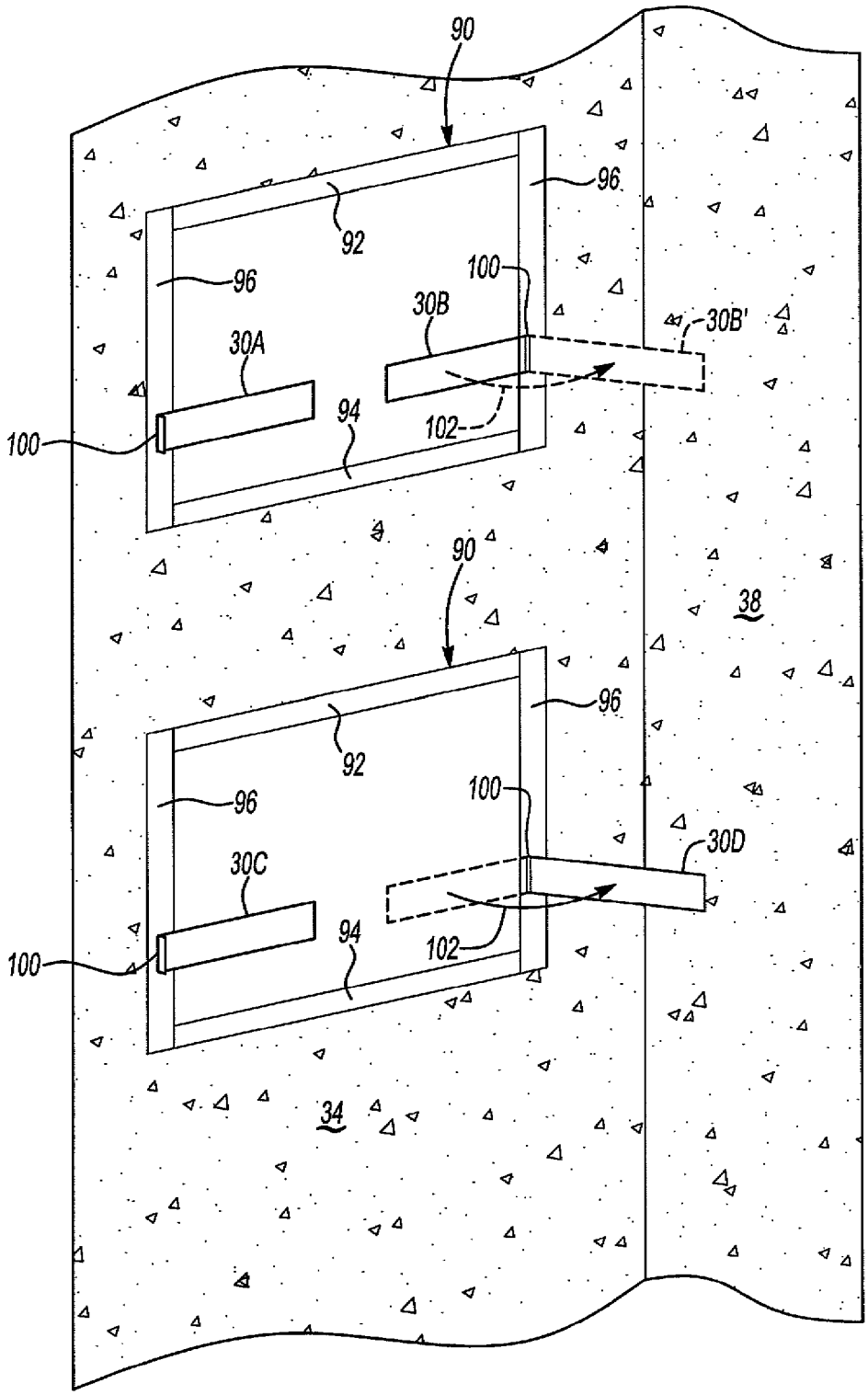
FIG. 5 schematically illustrates an arrangement of elevator system door frames and associated guide rail brackets.

FIG. 5 illustrates a plurality of door frames 90 in selected positions along a hoistway. The front wall 34 includes the doorways at which the door frames are located. Each of the example door frames 90 includes a plurality of door frame members such as a header 92, a sill 94 and jambs 96. As can be appreciated from the drawing, the door frame members are all generally parallel to the wall 34.

Figure 6:
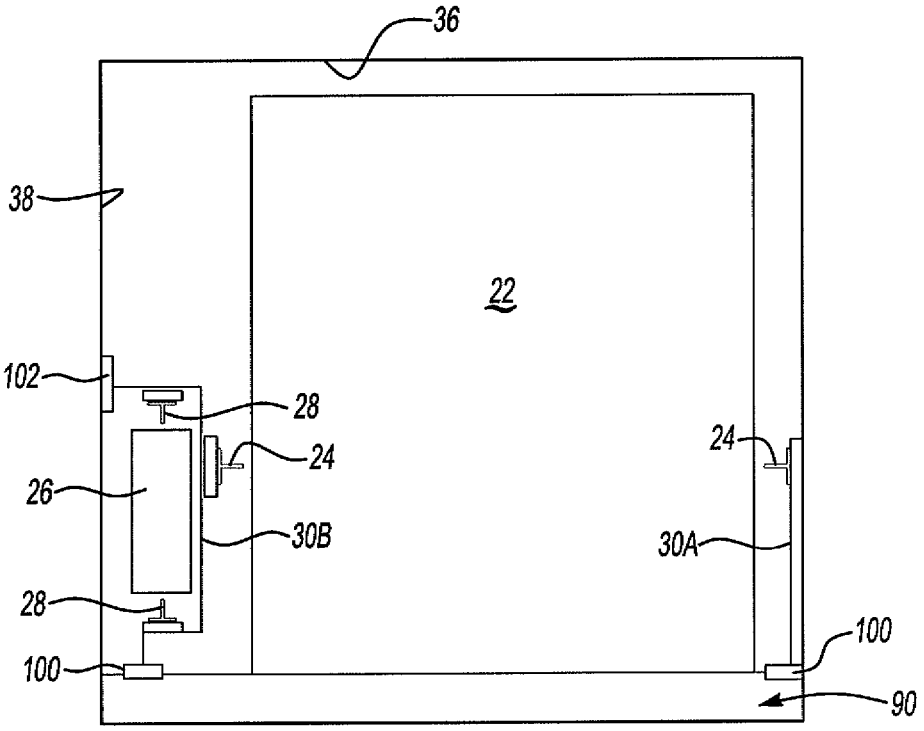
FIG. 6 schematically illustrates one example configuration consistent with the example of FIG. 5.

At least one of the door frame members supports at least one guide rail bracket 30. In the illustration, each jamb 96 supports a guide rail bracket 30. The illustration includes four guide rail brackets 30A, 30B, 30C and 30D. In one example, the guide rail brackets 30B and 30D are configured like the example shown in FIGS. 1-4. In another example, the guide rail brackets 30B and 30D have a configuration as shown in FIGS. 5 and 6. The guide rail brackets 30A and 30C are responsible for positioning and stabilizing only one guide rail for the elevator car 22 in this example and, therefore, have a different configuration compared to the guide rail brackets 30B and 30D.

The guide rail brackets 30 are each moveable relative to the door frame members between a handling position and a deployed position. The guide rail brackets 30A, 30B and 30C are shown in an example handling position. In one example, the handling position is used for shipping, storage and initial installation of the door frames 90. The guide rail brackets 30 are generally parallel to at least one of the header 92 or the sill 94 when they are in the handling position. If the door frames 90 are positioned as shown in FIG. 5, the guide rail brackets 30 are generally parallel to the hoistway wall 34.

As can be appreciated from drawings, the guide rail bracket can include various portions arranged at various angles relative to each other. In the example handling position, at least the base 40 of the guide rail bracket is generally parallel to at least one of the header 92 or the sill 94. As can be appreciated from the drawings, in some examples base 40 is the longest portion of the guide rail bracket.

In the example handling positions, the base 40 of each guide rail bracket 30 may be at an oblique angle relative to the header 92 or sill 94 and still be considered generally parallel to the header 92 or sill 94. In one example any angular alignment less than 25 degrees is considered generally parallel.

In the illustration, the guide rail bracket 30D is shown in the deployed position. In this example, the guide rail brackets 30 are generally perpendicular to at least one of the header 92 or sill 94 when in the deployed position. In the example, deployed position, the base of each guide rail bracket is generally aligned with (e.g., parallel to) a corresponding lateral wall of the hoistway. The term "generally perpendicular" used in this description does not require an exact 90 degree alignment between the relevant components. An oblique angle between 75 degrees and 105 degrees is considered generally perpendicular in one example.

The guide rail bracket 30D is shown already moved from a handling position (shown in phantom) to the deployed position. In that position, the guide rail bracket 30D is generally parallel to the lateral wall 38. The deployed position of the guide rail bracket 30B is shown at 30B' (in phantom).

There are a variety of ways of supporting the guide rail brackets 30 to be moveable relative to the door frame members. In the illustrated example, the guide rail brackets are pivotally moveable relative to the door frame members. Moveable connectors 100 are used in one example to secure one end of each guide rail bracket relative to the associated door frame member. The moveable connectors 100 facilitate moving the guide rail brackets 30 between the handling position and the deployed position as shown by the arrows 102 in FIG. 5. In one example, the moveable connectors comprise hinges.

With the illustrated arrangement, once the door frames 90 are aligned with the hoistway and each other, the placement of the guide rails 24 and 28 is already determined once the guide rail brackets are moved from the handling position to the deployed position. This enhances economies associated with elevator system installation. Once the door frames are set, the task of installing the guide rails 24 and 28 is greatly simplified because the position of each rail supporting portion of the guide rail brackets is controlled by the configuration of the guide rail bracket and its relationship with the door frame.

FIG. 6 illustrates one example installation in which the guide rail bracket 30B is at least partially supported by the adjacent lateral wall 38 of the hoistway. In this example, a mounting member 102 secures the guide rail bracket to the wall 38 near one end of the bracket. The other end is secured in position relative to the door frame. The guide rail bracket 30A in this example need not be supported by the adjacent wall.

Figure 7:
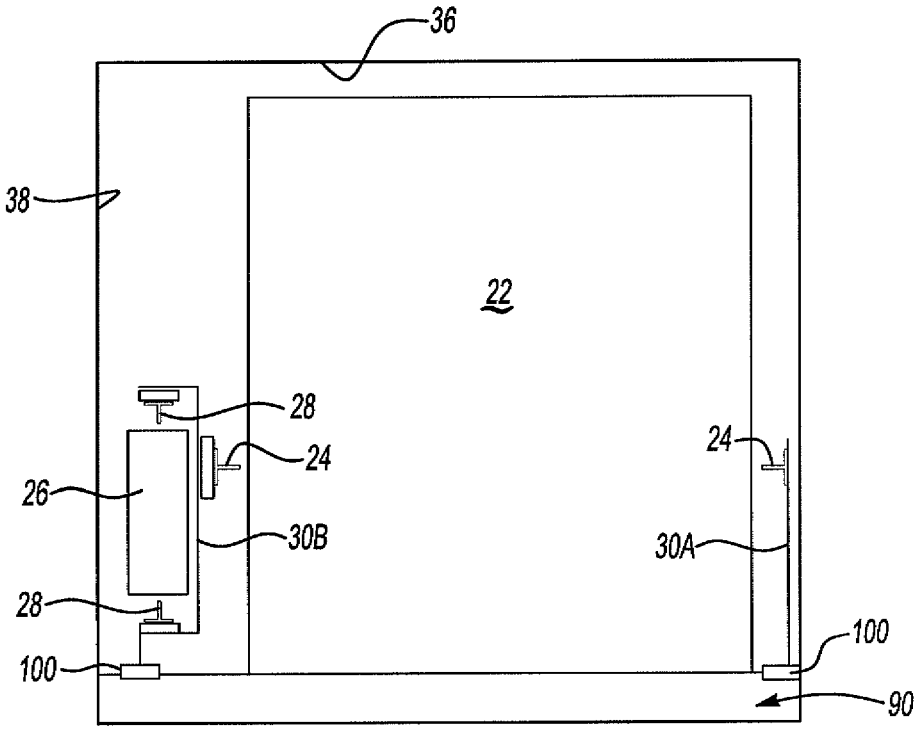
FIG. 7 schematically illustrates another example configuration consistent with the example of FIG. 5.

FIG. 7 shows another arrangement in which the guide rail bracket 30B is maintained spaced from the lateral wall 38. The way in which both guide rail brackets 30B and 30A are supported on the door frame is secure enough to maintain the guide rail brackets and corresponding portions of the associated guide rails in desired positions in the hoistway.

In one example, at least one of the guide rail brackets on each side of the elevator car 22 is secured to the associated door frame 90 and the adjacent lateral wall in the hoistway while others are not secured to the lateral walls. Whether a guide rail bracket is received against and secured to an adjacent hoistway wall depends, in part, on a distance between the associated door frame member and that hoistway wall, a position of the guide rail bracket relative to the door frame and a configuration of the guide rail bracket. Eliminating a requirement for securing at least some of the guide rail brackets directly to a lateral wall can further reduce the costs associated with installing an elevator system.

As can be appreciated from FIGS. 6 and 7, the guide rail brackets 30B have a modified configuration compared to that shown in FIGS. 3 and 4. In the example of FIGS. 6 and 7, the guide rail bracket 30B still has the counterweight guide rails 28 both supported by a single bracket structure at the corresponding vertical location in the hoistway. The counterweight 26 and the guide rails 28 can all fit within a front quadrant of the hoistway on one side of the elevator car 22 much like that which is possible using the example bracket of FIGS. 3 and 4. Of course, other guide rail bracket configurations are possible.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A door frame assembly useful in an elevator system, comprising:

a plurality of door frame members including a header, a sill and jambs, the door frame members being configured to be located in a desired position along a hoistway; and at least one guide rail bracket supported by at least one of the door frame members, the guide rail bracket being moveable relative to the at least one of the door frame members between a handling position in which at least a base of the guide rail bracket is generally parallel with at least one of the header or the sill and a deployed position in which at least the base of the guide rail bracket is generally perpendicular to the at least one of the header or the sill, the at least one guide rail bracket being situated for facilitating installing a guide rail in the elevator system in the deployed position.

2. The assembly of claim 1, wherein the guide rail bracket base has a length that is longer than any other portion of the guide rail bracket.

3. The assembly of claim 1, wherein the guide rail bracket is pivotally moveable relative to the at least one of the door frame members.

4. The assembly of claim 1, comprising a hinge securing the guide rail bracket to the at least one of the door frame members.

5. The assembly of claim 1, wherein the at least one of the door frame members is spaced a distance from a wall of the hoistway that is perpendicular to the at least one of the header or the sill and the guide rail bracket is supported in a position such that a portion of the guide rail bracket is received against the wall in the deployed position.

6. The assembly of claim 1, wherein the at least one of the door frame members is spaced a distance from a wall of the hoistway that is perpendicular to the at least one of the header or the sill and the guide rail bracket is supported in a position such that the guide rail bracket is spaced away from the wall in the deployed position.

7. The assembly of claim 1, wherein the guide rail bracket comprises:

a car guide rail support arm near a first end of the base, the car guide rail support arm being adapted to secure a corresponding portion of a car guide rail in a desired position within a hoistway; and a plurality of counterweight guide rail support arms between the car guide rail support arm and a second, opposite end of the base, the counterweight guide rail support arms each being adapted to secure a corresponding portion of a counterweight guide rail in a desired position within a hoistway.

8. The assembly of claim 7, wherein the base, the car guide rail support arm and the counterweight guide rail support arms are all part of a single, integrated structure.

9. The assembly of claim 7, wherein the base has one end section at the second end bent relative to a remainder of the base and one of the counterweight guide rail support arms comprises the bent end section.

10. The assembly of claim 7, wherein the car guide rail support arm comprises three sections of the base near the first end that are bent to be transverse to each other.

11. The assembly of claim 10, wherein a first one of the sections extends in a direction away from the base, a second one of the sections extends from the first one of the sections in a direction parallel to the base and a third one of the sections extends from the second one of the sections in a direction toward the base.

12. The assembly of claim 7, wherein the car guide rail support arm has a rail receiving surface in a first orientation relative to the base and the counterweight guide rail support arms each has a rail receiving surface in a second, different orientation relative to the base.

13. The assembly of claim 12, wherein the car guide rail support arm rail receiving surface is parallel to the base surface and the counterweight guide rail support arms rail receiving surfaces are generally perpendicular to the base surface.

14. The assembly of claim 7, wherein the base comprises a single metal plate:

the car guide rail support arm comprises a bent portion of the metal plate near the first end;

one of the counterweight guide rail support arms comprises a bent portion of the metal plate near the second end; and another one of the counterweight guide rail support arms comprises another piece of metal secured to the base plate at a selected distance from the one of the counterweight guide rail support arms.

* * * * *